United States Patent [19]

Zulauf et al.

[11] Patent Number: 4,816,643

[45] Date of Patent: Mar. 28, 1989

[54] GLOW PLUG HAVING A METAL SILICIDE RESISTIVE FILM HEATER

[75] Inventors: Gary B. Zulauf, Findlay; David C. Weber, Toledo, both of Ohio

[73] Assignee: Allied-Signal Inc., Morristown, N.J.

[21] Appl. No.: 23,934

[22] Filed: Mar. 9, 1987

Related U.S. Application Data

[63] Continuation of Ser. No. 713,224, Mar. 15, 1985, abandoned.

[51] Int. Cl.[4] ..... H05B 3/00; F23Q 7/00; F02P 19/02

[52] U.S. Cl. ..... 219/270; 123/145 A; 219/543; 219/553; 338/308; 361/366; 431/208

[58] Field of Search ..... 219/260–270, 219/544, 522, 552, 553, 543; 338/308, 309; 361/264–266; 123/145 R, 145 A; 431/208, 258

[56] References Cited

U.S. PATENT DOCUMENTS

| | | | |
|---|---|---|---|
| 2,484,544 | 10/1949 | Bennett et al. | 219/270 |
| 3,017,540 | 1/1962 | Lawser | 219/260 |
| 3,172,074 | 3/1965 | Drewes et al. | 338/308 X |
| 3,177,341 | 4/1965 | De Woody et al. | 338/309 X |
| 3,810,734 | 5/1974 | Willson | 431/258 |
| 3,912,905 | 10/1975 | Giler | 219/464 |
| 4,359,490 | 11/1982 | Lehrer | 427/95 |
| 4,418,661 | 12/1983 | Esper et al. | 123/145 A |
| 4,426,568 | 1/1984 | Kato et al. | 219/270 |
| 4,437,440 | 3/1984 | Suzuki et al. | 123/145 A |
| 4,468,308 | 8/1984 | Scovell et al. | 204/192 |
| 4,545,339 | 10/1985 | Brooks et al. | 219/270 X |
| 4,582,981 | 4/1986 | Brooks et al. | 219/270 |

FOREIGN PATENT DOCUMENTS

| | | | |
|---|---|---|---|
| 129676 | 1/1985 | European Pat. Off. | 219/270 |
| 400854 | 8/1924 | Fed. Rep. of Germany | 123/145 A |
| 2446348 | 4/1976 | Fed. Rep. of Germany | 338/258 |
| 3231781 | 3/1984 | Fed. Rep. of Germany | 123/145 A |
| 3318458 | 11/1984 | Fed. Rep. of Germany | 123/145 A |
| 489225 | 9/1918 | France | 123/145 A |
| 599233 | 10/1959 | Italy | 123/145 A |
| 116809 | 1/1984 | Japan . | |
| 59-170620 | 9/1984 | Japan | 219/270 |
| 59-176517 | 10/1984 | Japan | 219/270 |
| 86805 | 11/1955 | Norway | 123/145 A |
| 1094522 | 12/1967 | United Kingdom . | |

OTHER PUBLICATIONS

Engineering Application Data Sheet, Kanthal Corporation, Bethel, Connecticut.

*Primary Examiner*—Anthony Bartis

*Attorney, Agent, or Firm*—Leo H. McCormick, Jr.; Ken C. Decker

[57] ABSTRACT

A glow plug has a heater member form by depositing a continuous metallic-silicide layer on the internal and external surfaces of a hollow open-ended cylindrical ceramic substrate. The metallic-silicide layer on the external surface of the substrate is electrically connected to a metal shell which supports one end of the heater member. An axial electrode disposed in the shell is electrically connected to the metallic-silicide layer disposed on the internal surface of the substrate and further serves together with a shoulder on the heater member to lock the heater member in the shell. The metallic-silicide resistive layer has a positive temperature coefficient of resistance and is substantially uneffected by micro-irregularities on the substrate surfaces to provide a cold resistance of from 0.2 to 0.6 ohms and is capable of responding to five amperes of current to develop a temperature of at least 800° C. within five seconds.

11 Claims, 2 Drawing Sheets

GLOW PLUG HAVING A METAL SILICIDE RESISTIVE FILM HEATER

This is a continuation of abandoned application Ser. No. 713,224 filed 3-15-85.

CROSS REFERENCE

The invention is related to the glow plug described in co-pending, commonly assigned patent Ser. No. 701,642 now U.S. Pat. No. 4,582,981 entitled "An Improved Glow Plug Having a Resistive Film Heater" filed Feb. 13, 1985.

BACKGROUND OF THE INVENTION

The invention is related to the field of electric heaters for the ignition of hydrocarbon fuels and in particular to a glow plug for internal combustion engines having a metallic silicide resistive film heater.

PRIOR ART

Electrically energized glow plugs are currently used in compression ignited or Diesel type internal combustion engines to assist in the ignition of compressed air/fuel mixtures during cold starts. In particular glow plugs are essential in the Northern states during the winter months when the ambient temperature falls below 10° C.

In commonly assigned U.S. Pat. Ser. No. 4,582,981 identified above entitled "An Improved Glow Plug Having A Resistive Surface Film Heater" filed June 23, 1983, a novel heater configuration was disclosed in which a noble metal resistive film was disposed along the external and internal surfaces of a cylindrical ceramic substrate. Although this type of glow plug has excellent performance characteristics which are superior to glow plugs currently used in automotive vehicles, difficulties have been experienced in the deposition of satisfactory noble metal resistive films due to microirregularities on the surfaces of the ceramic substrate and the thinness of the noble metal films required to achieve the desired resistivity. The object of the invention is the substitution of a metallic-silicide film for the noble metal film which because of the higher resistivity of the metallic silicides permits the use of thicker resistive films which are less sensitive to the microirregularities of the ceramic structure, have a higher melting temperature which permits the glow plug to be operated at higher temperatures, and have a larger positive coefficient of resistance potentially making the glow plug self-limiting reducing the requirements of the attendant controller.

The use of metallic-silicides for heater elements is well-known in the art. The Kanthal Corporation of Bethel, Connecticut makes a variety of heater elements using metal silicides as the resistive element. These heater elements take the form of a metallic silicide as were disclosed by Giler in U.S. Pat. No. 3,912,905 or a layer of metallic-silicide formed over an insulating or ceramic layer disposed over a metal wire for structural strength as disclosed by Willson in U.S. Pat. No. 3,810,734. Suzuki et al, in U.S. Pat. No. 4,437,440 discloses a glow plug having a tubular molybdenum disilicide ($MoSi_2$) element in which electrical contact is made between the shell and an axial electrode contacting the closed end of the tubular heating element.

SUMMARY OF THE INVENTION

The invention is a glow plug for internal combustion engines of the type having a metal shell, and an axial electrode disposed in the metal shell and electrically insulated therefrom, a heater member electrically connected between the metal shell and the axial electrode characterized by a cylindrical substrate and a continuous metallic-silicide resistive layer disposed on the surfaces of the cylindrical substrate. The substrate has an internal portion disposed in the shell and captivated between one end of the shell and the axial electrode, and an external portion protruding external to the shell. The metallic-silicide resistive layer is disposed along the internal and external surfaces of the cylindrical substrate and around the end of said external portion. The portion of the resistive layer disposed on the external surface of the substrate being in electrical contact with the metal shell and the portion of the resistive layer disposed on the internal surface being in electrical contact with the axial electrode.

The advantages of the glow plug is that the interior of the cylindrically shaped heater member forms an extremely hot cul-de-sac which is not cooled by the impinging air/fuel mixture. Another advantage is that the metallic-silicide resistive layer is relatively insensitive to oxidation and the corrosive atmosphere inside the engine. Another advantage is that the low mass of the heater member permits the glow plug to reach an operating temperature in less than 5 seconds with an applied power of less than 60 watts. These and other advantages of the glow plug will become more apparent from a reading of the specification in conjunction with the figures.

DETAILED DESCRIPTION OF THE INVENTION

Figure 1:
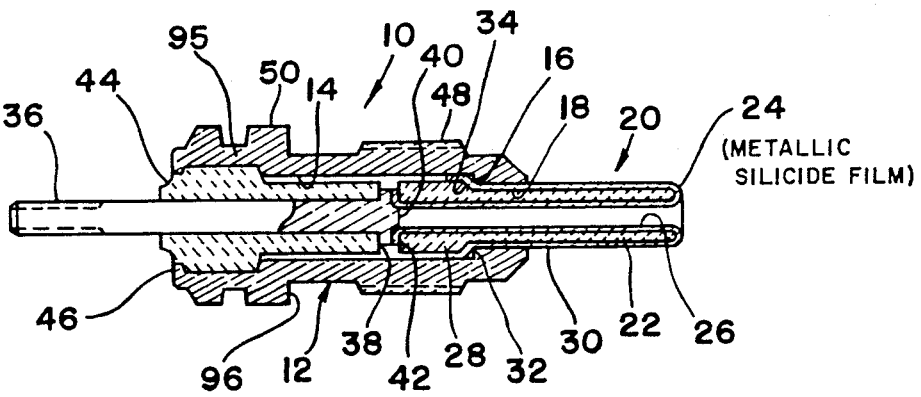
FIG. 1 is a cross-sectional view of the glow plug embodying the cylindrical ceramic heater member.

A cross-sectional view of the glow plug is shown in FIG. 1. The glow plug comprises a cylindrical metal shell 12 having an internal bore 14. Formed at one end of the shell 12 is a contact seat 16 defining a heater aperture 18. Located in the internal bore 14 is a heater member 20 having a resistive metallic-silicide surface film heater element 24 coated or disposed on at least one surface of a non-conductive cylindrical substrate 22 as shall be described hereinafter. The non-conductive substrate 22 is preferably a high temperature ceramic, such as alumina, but may be quartz, a high temperature glass or a metal sleeve coated with an insulating material. The cylindrical substrate 22 has an internal bore 26 passing therethrough, a base or internal portion 28 disposed in shell 12 and a smaller diameter external portion 30 protruding externally from the shell 12 through the heater aperture 18. The heater aperture 18 has a diameter smaller than the diameter of the internal portion 28 of the substrate 22 and larger than the diameter of the external portion 20.

An axial electrode 36 having a radial flange 38 and guide finger 40 formed at one end is received in the internal bore 26 of the cylindrical substrate 22 with the radial flange abutting the internal end face of the cylindrical substrate 22. The axial electrode 36 produces a force on the end of the cylindrical substrate 22 sufficient to deform an electrically conductive gasket 32 interposed between shoulder 34 of the cylindrical substrate 22 and the shell contact seat 16. The conductive gasket 32 may be copper, gold or any other malleable metal or alloy.

A cylindrical insulator member 44, similar to the insulator commonly used in spark plugs, is inserted in bore 14 circumscribing axial electrode 36 and abutting the opposite face of radial flange 38. The end of the shell 12 is crimped over to form a peripheral lip 46. The insulator member 44, axial electrode 36 and heater member 20 are then locked tightly inside of shell 12 by a hot press operation which heats and then cools the undercut groove 95 while a compressive force is applied between peripheral lip 46 and the opposing end 96 of an external hexagonal portion 50. The shell 12 further includes an externally threaded portion 48 for mounting the glow plug in the engine. The external hexagonal portion 50 facilitates threading the glow plug 10 into an appropriate threaded aperture of the engine.

One advantage of the glow plug 10 shown in FIG. 1 is that the electrical connections between the surface film heater element 24, the shell 12 and the axial electrode 36 are made internally of shell 12 where they are protected from the high temperatures and corrosive atmosphere inside the engine. This configuration eliminates the erosion problems of the electrical connections between the metallic silicide film, the shell 12 and the axial electrode 36.

Figure 2:
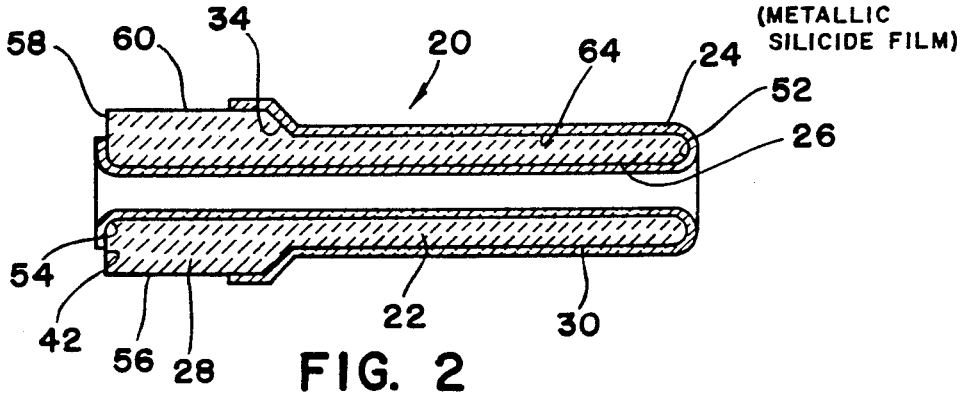
FIG. 2 is a cross-sectional view of a first embodiment of the cylindrical heater member.

The details of the preferred embodiment of the heater members 20 are illustrated in FIG. 2. Referring to FIG. 2, the heater member 20, as previously described, has a generally cylindrical ceramic substrate 22 having an axial bore 26, an internal portion 28, a smaller diameter external portion 30 and a sloped shoulder 34 connecting the external surfaces of the internal portion 28 and external portion 30. Radii are provided at the edges at the substrate's end face 52 to blend the end face 52 with the contiguous internal surface of bore 26 and the external surface 64 of the substrate or a full radius may be provided as shown. In a similar manner, a radius 54 is provided at the base of the substrate blending the end face 42 with the internal surface of bore 26.

A continuous resistive metallic-silicide film 24, such as molybdenum disilicide ($MoSi_2$), tungsten disilicide ($WSi_2$), tantalum disilicide ($TaSi_2$), or titanium disilicide ($TiSi_2$), is deposited along the sloped shoulder 34, along the length of the external surface 64, around the end 52, then along the internal surface of bore 26 and terminate on end face 42 at a point intermediate the internal and external diameters of the substrate. The metallic-silicide layer 24 may also be extended a short distance along the length of the external surface 60 of substrate 22 as shown.

The opposite ends of the metallic-silicide layer 24 are electrically isolated by the uncoated region 56 of the external surface 60 and an uncoated peripheral region 58 of the end face 42. The metallic-silicide coating or film 24 may be applied to the desired surfaces of the substrate 22 by chemical vapor deposition techniques or any other method known in the art. Since the deposition techniques for metallic-silicide films have been extensively developed for low-resistance contacts in the solid state industry, it is not necessary to describe in detail how the metallic-silicide films are deposited for an understanding of the invention.

Figure 6:
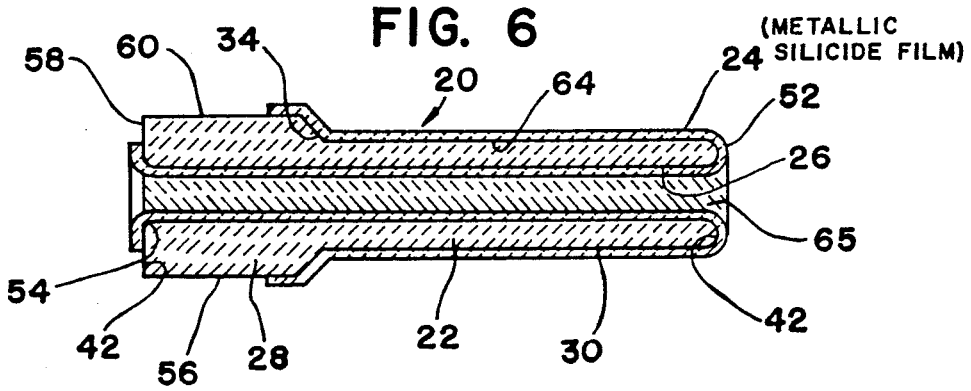
FIG. 6 is a cross-sectional view of an embodiment of the heater member having the interior of the cylindrical substrate filled with alumina.

In practice, the uncoated areas may be protected by mechanical shields during the deposition process. However, the entire substrate may be coated and the metallic-silicide layer removed from the insulator regions 56 and 58 by air abrasion. As shown in FIG. 6, the interior of the cylindrical substrate after it has been coated with a metallic silicide may be filled with a dielectric material 65, such as alumina, to increase the structural strength of the ceramic substrate.

Figure 3:
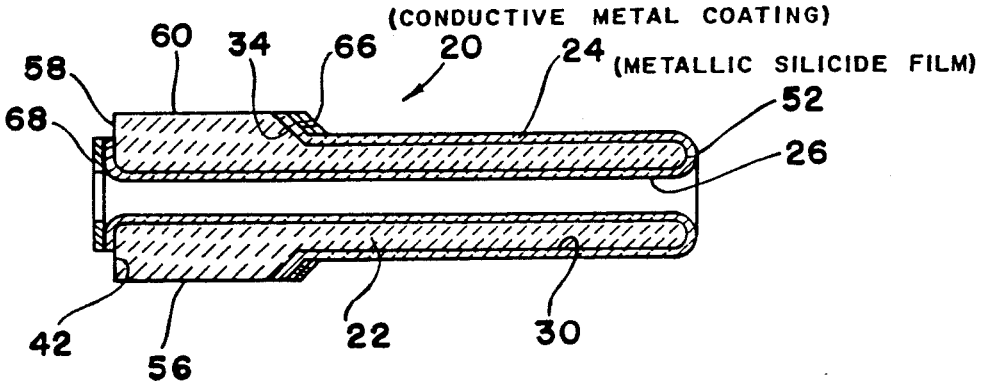
FIG. 3 is a cross-sectional view of a second embodiment of the cylindrical heater member.

In the embodiment shown on FIG. 3, highly conductive metal coating 66 and 68 may be applied over metallic silicide layer 24 disposed on the sloped shoulder 34 and the internal end face 42 respectively to assure good electrical contact between the metallic silicide surface layer 24, the heater seat 16, and the axial electrode 26, respectively.

Figure 4:
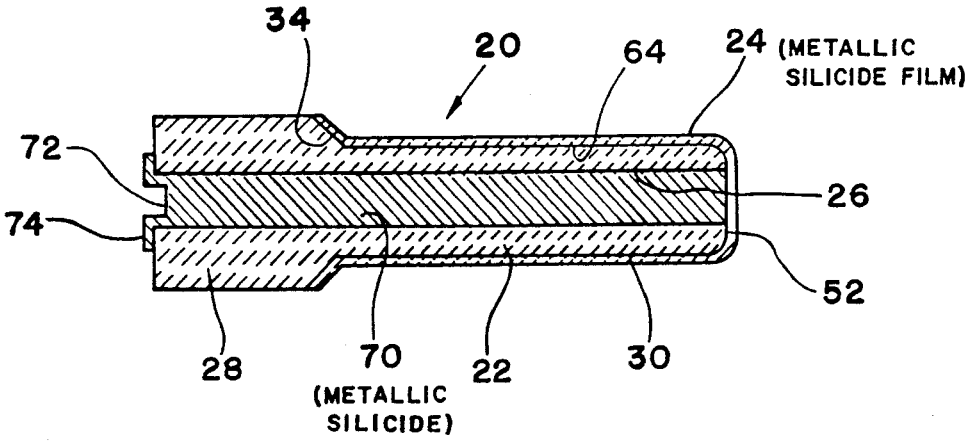
FIG. 4 is a cross-sectional view of an embodiment of the heater member having the interior of the ceramic filled with a metallic silicide.
Figure 5:
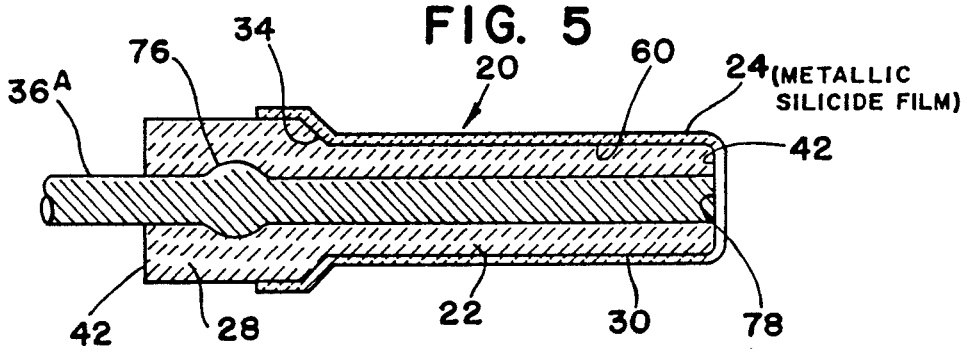
FIG. 5 is a cross-sectional view of an embodiment of the heater member having the cylindrical substrate formed around the axial electrode.

In the embodiment shown on FIG. 4, the length of the axial bore 26 is completely filled with metallic-silicide material or other suitable conductive material to form an internal conductor 70 and the resistive metallic-silicide layer 24 is deposited along the length of the substrates external surfaces 34 and 64 and over the end 52 to make electrical contact with the internal conductor 70 filling external bore 26. The internal conductor 70 filling the bore 26 may have a recess 72 formed at the end face 42 of the substrate 22 to receive the guide finger 40 of the axial electrode 36 and may be extended onto the end face 42 to provide a contact region 74 for the axial electrodes radial flange 38. Alternatively, the ceramic substrate may be formed directly around an axial electrode 36A and the resistive metallic-silicide film 24 deposited along the external surfaces 34 and 60 of the substrate 22 and over the end surface 78 of the axial electrode 36A as shown in FIG. 5. In this embodiment, the axial electrode 36 has a protrusion 76 adjacent to the interior portion 28 of the cylindrical substrate 22 to longitudinally lock the substrate 22 to the axial electrode 36A prevents any possible longitudinal shifting of the substrate 22 with respect to the axial electrode which would fracture or cause any electrical discontinuities at the junction between the metallic-silicide film 24 and the end face 78 of the axial electrode 36A. A highly conductive metal coating such as coating 66, shown in FIG. 3, may be deposited over the sloped shoulder 34 to assure good electrical contact between the shell 12 and the resistive metal-silicide layer 24.

Preferably the cold resistance of the resistive metallic-silicide heater element 24 is between 0.2 and 0.6 ohms, which permits the heater member 20 to achieve an operating temperature of greater than 800° C. with a current flow of less than 5 amperes when using a 12 volt source of electrical power, such as an automotive battery.

The primary advantage of the cylindrical configuration of the heater member 20 shown on FIGS. 2 and 3 is that the bore 26 forms a high temperature cul-de-sac adjacent to its external end which is isolated from the cooling effects of the swirling air/fuel mixture in the engine's ignition chamber.

Other advantages of the heater member 20 are:

1. The low mass of the cylindrical substrate 22 and the metallic-silicide surface layer 24 permits the glow plug to reach an operating temperature, greater than 800° C., in less than 5 seconds with an applied electrical power of approximately 60 watts.

2. When compared with a noble metal surface layer, the watt density of the metallic-silicide surface layer on the cylindrical substrate is less than that of a noble metal at any given temperature thereby reducing the current requirements in the system.

3. The electrical connections to the metallic-silicide surface layer are made internally of the shell 12, reducing their exposure to the higher engine temperatures and thereby reducing their oxidation and/or corrosion.

4. The positive temperature coefficient of the metallic-silicide surface layer heater element tends to make the glow plug less susceptible to variations in the applied voltage and easier to control.

5. The metallic-silicide heater element is highly resistive to the corrosive atmosphere inside the engine.

6. The components of the glow plug are applicable to standard spark plug manufacturing processes and therefore are potentially less costly than other types of glow plugs.

It is recognized that the configuration of the various elements of the glow plug may be changed from those shown in the drawings or discussed in the specification without departing from the spirit of the invention as described herein and set forth in the appended claims.

Having described the invention what is claimed is:

1. In a glow plug of the type having a cylindrical metal shell with a peripheral seat defining a heater aperture at said one end thereof, an axial electrode disposed in said metal shell, insulator means supporting said axial electrode concentrically in said metal shell and electrically insulating it therefrom, and a heater member electrically connected between the metal shell and the axial electrode, the improvement wherein said heater member comprises:

a hollow open-ended cylindrical ceramic substrate having an internal surface and an external surface, said substrate having an internal portion secured in the shell between one end of the shell and one end of said axial electrode and an external portion protruding externally from the shell, said internal portion of said cylindrical substrate having a shoulder portion engaging said peripheral seat of said shell, said ceramic substrate having micro-irregularities on said internal and external surfaces; and a continuous metallic-silicide resistive layer disposed along the internal and external surfaces of said cylindrical substrate and around the end of said external portion to form a hollow cylindrical heater element open at the end of said external portion, the portion of said resistive layer disposed along the external surface of said substrate being electrically connected to the metal shell and the portion of said resistive layer disposed along the internal surface of said substrate being electrically connected to the axial electrode, said external portion passing through said heater aperture, said resistive layer being disposed along said external surface extending along the surface of said shoulder portion of said cylindrical substrate, said axial electrode having a radial flange engaging the end of said internal surface of said cylindrical substrate, said resistive layer being disposed along the internal surface of said substrate to the surface of the end of said internal surface to form an electrical contact area having a diameter intermediate the internal and external diameters of said internal end portion, said radial flange of the axial electrode making electrical contact with said contact area, said metallic-silicide resistive layer being substantially uneffected by said micro-irregularities on said internal and external surfaces to provide a cold resistance of from 0.2 to 0.6 ohms to the flow of electrical current, said resistive layer responding to five amperes of electrical current to develop a temperature of at least 800° C. within five seconds, said metallic-silicide resistive layer having a positive coefficient of resistance to provide for self limiting which reduces the operating requirements of a controller.

2. The heater member of claim 1 having a metal film disposed on the surface of said resistive layer on said shoulder portion and on said contact area to lower the electrical contact resistance between the metal shell and the axial electrode and the resistive layer disposed along the external and internal surfaces of said cylindrical substrate.

3. The heater of claim 2 having an electrically conductive gasket disposed between said shoulder portion of the cylindrical substrate and said peripheral seat.

4. The heater member of claim 1 wherein said metallic-silicide resistive layer is a molybdenum disilicide resistive layer.

5. The heater member of claim 1 wherein said metallic-silicide resistive layer is a tungsten disilicide resistive layer.

6. The heater member of claim 1 wherein said metallic-silicide resistive layer is a tantalum discilicide resistive layer.

7. The heater member of claim 1 wherein said metallic-silicide resistive layer is a titanium discilicide resistive layer.

8. The heater member of claim 1 having a dielectric material filling the interior of the cylindrical substrate.

9. A glow plug comprising:

a metal shell having a cylindrical internal chamber and a peripheral seat to define a heater aperture at one end thereof;

a hollow open-ended cylindrical ceramic substrate having an external surface and an internal surface, said ceramic substrate having a first portion disposed in said internal chamber adjacent to said heater aperture and a second portion extending longitudinally through said heater aperture externally from said metal shell, said internal and external surfaces having micro-irregularities thereon, said external surface of said first portion having a sloped shoulder which engages said peripheral seat;

a metallic-silicide resistive layer deposited on said sloped shoulder, internal and external surfaces, and around the end of said second portion to form a hollow cylindrical heater element open at both ends, said resistive layer having a cold resistance of from 0.2 to 0.6 ohms to the flow of electrical current, the portion of said resistive layer disposed along said external surface being in electrical contact with said shell;

an axial electrode disposed in said shell and having a radial flange which engages the end of said first portion to secure said cylindrical substrate in said shell, said resistive layers disposed along the internal surface of said substrate extending along the surface of the end of said first portion to form an electrical contact area having a diameter intermediate the internal and external diameters of said first portion of said cylindrical substrate; and an insulator disposed in said shell for supporting said axial electrode in engagement with said cylindrical substrate and electrically insulating said axial electrode from said shell, said metallic silicide resistive layer being substantially uneffected by said micro-irregularities on said internal and external surfaces by responding to five amperes of electrical current to permit said glow plug to operate at temperatures above 800° C. within five seconds, said metallic-silicide resistive layer having a positive coefficient of resistance to provide for self limiting which reduces the operating requirements of a controller.

10. The glow plug of claim 9 having a metal layer disposed along the surface of the resistive layer disposed on said sloped shoulder and said contact area.

11. The glow plug of claim 9 having a dielectric filling the interior of said cylindrical substrate.

* * * * *